United States Patent [19]

Gwynn

[11] Patent Number: 4,906,982

[45] Date of Patent: Mar. 6, 1990

[54] PERSONAL INSPIRATIONAL DISPLAY DEVICE

[76] Inventor: Spencer Gwynn, 4459 Buckfield Ter., Trevose, Pa. 19047

[21] Appl. No.: 185,502

[22] Filed: Apr. 25, 1988

[51] Int. Cl.[4] ..... G09G 3/00

[52] U.S. Cl. ..... 340/706; 368/10

[58] Field of Search ..... 340/700, 706, 791, 825.19, 340/825.44; 368/10, 41, 42, 43

[56] References Cited

U.S. PATENT DOCUMENTS

| | | | |
|---|---|---|---|
| 3,937,002 | 2/1976 | Van Haaften | 368/225 |
| 3,948,037 | 4/1976 | Carlone | 368/225 |
| 3,983,350 | 9/1976 | Camin | 368/225 |
| 4,095,408 | 6/1978 | Kashio | 368/225 |
| 4,115,995 | 9/1978 | Brien | 368/225 |
| 4,129,982 | 12/1978 | de la Cruz | 368/225 |
| 4,534,012 | 8/1985 | Yokozawa | 368/10 |
| 4,698,783 | 10/1987 | Nishimuro et al. | 368/10 |
| 4,712,923 | 12/1987 | Martin | 368/41 |

*Primary Examiner*—David K. Moore
*Assistant Examiner*—Jeffery A. Brier
*Attorney, Agent, or Firm*—Howson and Howson

[57] ABSTRACT

A wristwatch includes the conventional time display and an additional preprogrammed message display which is activated unpredictably on some, but not all of the occasions when the wearer's arm is raised to check the time. The probability of occurrence of a message display is adjustable.

15 Claims, 1 Drawing Sheet

PERSONAL INSPIRATIONAL DISPLAY DEVICE

BRIEF SUMMARY OF THE INVENTION

This invention relates to inspirational displays, that is devices which electronically exhibit transient messages in the form of words, symbols or graphics for the purpose of motivating human activity. More particularly, the invention relates to a personal display device which can be carried by an individual, and which exhibits a message to the individual at unpredictable times.

Electronic inspirational displays are commonly used in retail establishments to motivate customers to purchase certain products. A typical display of this type comprises a bank of light-emitting diodes and driving circuitry responsive to a programmable memory. A message, for example a message suggesting the purchase of a particular product, is displayed periodically on the LED bank, usually in moving or sequentially appearing characters to attract attention. Similar displays are used in business establishments to exhibit motivational messages to employees.

Retail displays are effective, even though they may exhibit the same message repeatedly over a long period of time, because customers view them only transiently. On the other hand, employee motivation messages must be changed frequently. Otherwise, the messages quickly lose their effect by reason of psychological habituation. An ordinary personal inspirational display also has the disadvantage that it loses its effect. Thus, a reminder note placed by an individual on a bulletin board or on a refrigerator door, for example, is useful to that individual only for a short time. After a short period of time, it is ignored.

The principal object of this invention is to provide a personal display device by which an individual can display to himself or herself a programmed inspirational message without causing the message to lose its effect.

The display device in accordance with the invention is preferably built into a digital wristwatch. It exhibits the message unpredictably in response to user activation. That is, the user may cause an activation signal to be generated, for example by checking the time on the wristwatch, and the display device will display the message on some, but not all of the occasions when the wearer checks the time.

The display device comprises a display means responsive to a triggering signal for producing a visually perceptible display of a message for a limited time. By way of example, the display can be a liquid crystal display (LCD), controlled by driving circuitry responsive to a permanently programmed or user-programmable memory. The device also includes means responsive to a voluntary human-produced stimulus for generating an activation signal. The activation signal can be generated by an orientation switch of the kind used to activate the time display of a digital wristwatch when the wearer's arm is raised and rotated to view the watch. The display device also includes means pseudorandomly responsive to the activation signals for producing triggering signals to operate the display means. Triggering signals are produced upon receipt of some, but not all of the activation signals. Thus, the wearer of the display device may look at the wristwatch several times during the day, but cannot know in advance whether or not the inspirational message will appear at any of those times.

Further objects and advantages of the invention will be apparent from the folling detailed description.

DETAILED DESCRIPTION

Figure 2:
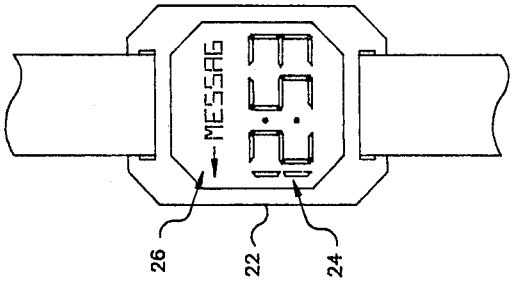
FIG. 2 is a plan view showing the face of a typical digital wristwatch embodying the display device of the invention.

The personal inspirational display device of the invention comprises a free-running pulse generator 10, which, if the invention is embodied in a wristwatch, can be any source of continuous pulses. The pulse rate is not critical. However, the rate should be around one pulse per second or greater to insure that the pseudorandom nature of the display occurrences is preserved. In the preferred embodiment shown in FIG. 1, the pulse generator includes the time base generator of a conventional electronic wristwatch along with part of the frequency dividing circuitry of the watch. The output of the pulse generator is connected to drive a conventional time counter and display 11.

The orientation switch 12 is an attitude-sensitive switch which closes momentarily when the display device containing it is moved to a predetermined attitude. Suitable attitude-sensitive switches have been designed to activate digital wristwatch displays when the wearer's arm is moved to allow the watch face to be viewed. A suitable switch, using inertia-responsive swinging mallets, is described in U.S. Pat. No. 3,937,002, issued Feburary 10, 1976, the disclosure of which is incorporated by reference. A predetermined motion of the wearer's arm is required to activate the time display. Other suitable switches are described in U.S. Pat. Nos. 3,948,037 (gravity-actuated switches), 3,983,350 (conductive liquid), 4,095,408 (movable ball in conductive cylinder having off-axis conductive rod), 4,115,995 (movable ball), 4,036,007 (inertia switch) and 4,129,982 (mercury switch), the disclosures of which patents are also incorporated by reference.

Display 14 can be any electronically activated display capable of exhibiting a message for a limited time. The preferred form of the display is an alphanumeric LCD display having the capability of showing several characters simultaneously. Display 14 is driven by conventional driving and message memory circuitry 16. The memory is preferably a random access memory which can be user-programmed at any time by a message programming control 18. The memory and display circuitry activates display 14 to exhibit the programmed message in response to a signal in line 20, and causes the message display to continue so long as the signal in line 20 is present. The memory and display circuitry can be of the type capable of producing a moving message, i.e. one moving from right to left. A moving message display can accommodate a message consisting of a number of characters exceeding the number simultaneously displayed.

The entire display and its associated electronic circuitry are preferably incorporated into a wristwatch 22 as shown in FIG. 2. The time display is indicated at 24, and a moving message display is indicated at 26.

Figure 1:
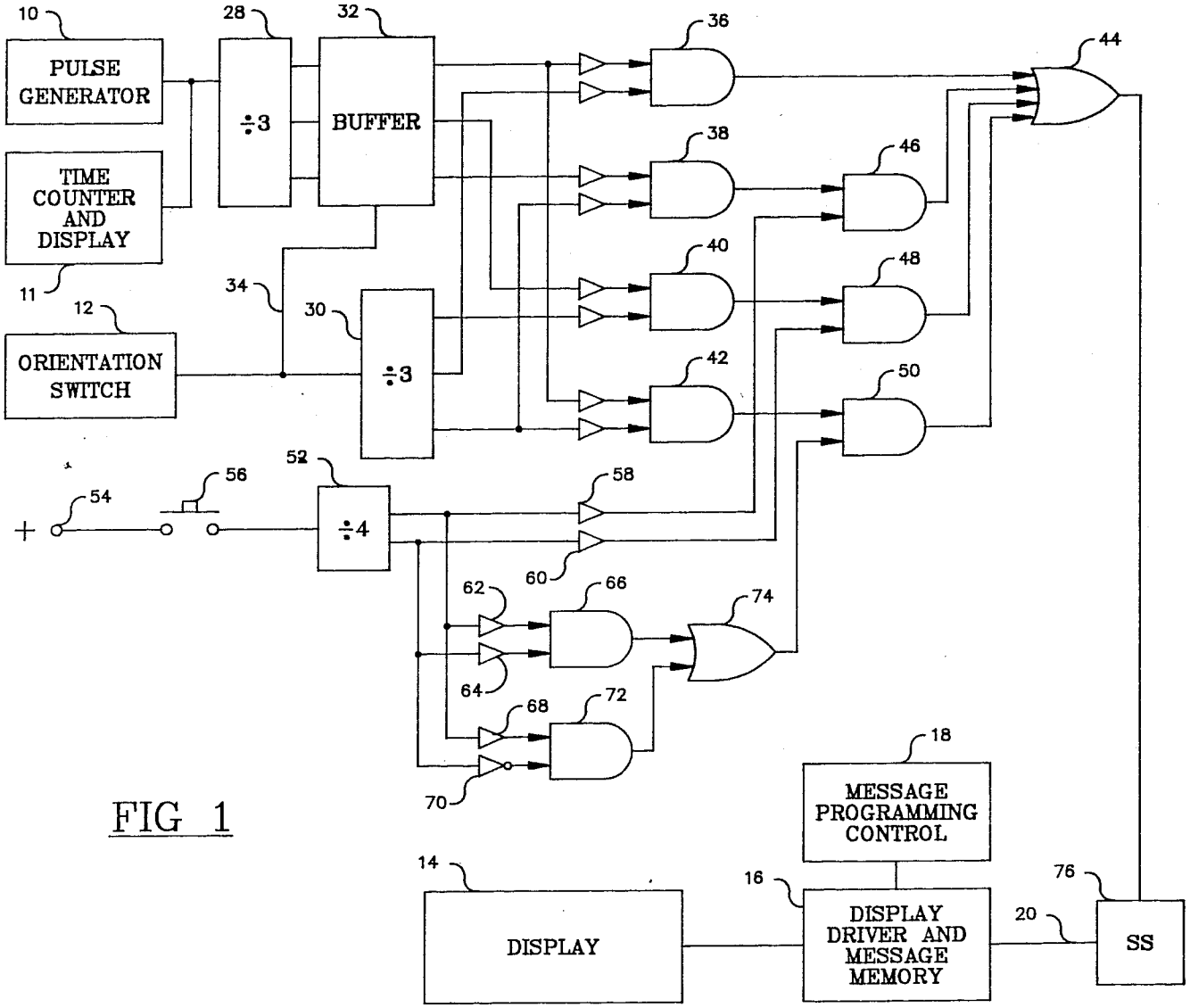
FIG. 1 is a schematic diagram of the display device, showing the display means, the activation signal-producing means, and a preferred form of pseudorandomly responsive display triggering circuit.

The logic circuitry for activating the message display is shown in FIG. 1 and comprises a pair of divide-by-three ring counters 28 and 30. Counter 28 receives the continuous pulse train output of pulse generator 10. It has three output lines which are activated in succession as the count proceeds. Only one of the output lines is activated or "high" at any given time. These outputs are delivered to a buffer register 32, which also has three outputs. The three outputs of the buffer memory are normally low. However, when a latch input line 34 goes high, the buffer holds the last count received from ring counter 28, and the output of the buffer corresponding to that count goes high and is held high. The other two outputs of the buffer are held low. The buffer outputs are held until the latch input returns to a low condition.

Orientation switch 12, when closed, delivers a signal simultaneously to the latch input of buffer register 32 and to divide-by-three ring counter 30. Each of the three outputs of buffer register 32 is connected to one of the inputs of two-input AND gates 36, 38 and 40, and each of the three outputs of counter 30 is connected to the other input of AND gates 36, 38 and 40. Connections to the AND gate inputs are made through driver amplifiers. In addition, one of the outputs of buffer register 32 is connected through a driver amplifier to an input of two-input AND gate 42, and one of the outputs of counter 30 is connected through a driver amplifier to the other input of AND gate 42. The driver-amplifiers are particularly desirable where a buffer or counter output is delivered to more than one AND gate.

The output of AND gate 36 is connected to one of the inputs of a four-input OR gate 44. The outputs of AND gates 38, 40 and 42 are connected respectively to inputs of two-input AND gates 46, 48 and 50, the outputs of which are connected to the other three inputs of OR gate 44.

A binary-output, divide-by-four counter 52 receives its input from positive supply terminal 54 through a normally open push-button switch 56. The two outputs of counter 52 are connected, through driver amplifiers 58 and 60 respectively, to the second inputs of AND gates 46 and 48. The counter outputs are also connected through driver amplifiers 62 and 64 to the inputs of two-input AND gate 66. They are also connected through driver amplifier 68 and inverting driver amplifier 70 to the inputs of two-input AND gate 72. The outputs of AND gates 66 and 72 are connected to the inputs of OR gate 74, the output of which is connected to the second input of AND gate 50.

The output of four-input OR gate 44 is connected to the input of monostable multivibrator 76, and the output of the multivibrator is connected through line 20 to the display-activating input of driver and memory circuit 16. Multivibrator 20 preferably has an "on" condition duration sufficient to permit the user to read a message filling the entire message memory of circuit 16. A typical "on" condition is five seconds. However, the "on" condition could be of a substantially longer duration without detrimental effect.

For any pair of outputs consisting of one output of buffer register 32 and one output of ring counter 30, the probability that both outputs will be in a "high" condition is 1/9. Assuming that gates 46, 48 and 50 are inactive, OR gate 44 will receive an input at an average rate of once for every operations of the orientation switch. This input is from the output of AND gate 36. The output of OR gate 44 triggers multivibrator 76 to activate the display for a limited period of time. Therefore, approximately once for every nine times the user checks the time, the message in the message memory will be displayed.

Each of AND gates 38, 40 and 42 produces an output on the average of once for every nine operations of the orientation switch. The outputs of gates 36–42 are non-coincident. Therefore, by switching the outputs of gates 38, 40 and 42 to the input of OR gate 44, it is possible to increase the probability that the display will be activated upon a given operation of the orientation switch. For example, if gate 48 is enabled, then OR gate 44 can respond to the outputs of AND gates 36 and 40 and the probability of display activation will be increased to 2/9. Gate 48 is enabled by the output of driver 60 when the count in binary counter 52 is one.

When the count in binary counter 52 is two, the output of driver 60 goes low and the output of driver 58 goes high. The output of AND gate 72 also goes high at a count of two, and therefore the output of OR gate 74 goes high. Consequently, gates 46 and 50 are both enabled, and OR gate 44 receives three possible inputs, one from each of AND gates 36, 46 and 50. The probability that the display will be activated upon operation of the orientation switch is 3/9.

When the count in binary counter 52 is three, the outputs of drivers 58 and 60 are both high. AND gate 66 delivers a high output to OR gate 74. Gates 46, 48 and 50 are all enabled and OR gate 44 receives four possible inputs. The probability that the display will be activated upon operation of the orientation switch is raised to 4/9.

A further actuation of push-button switch 56 returns the count in counter 52 to zero, and the probability of display activation is returned to 1/9. Thus, by activating push-button switch 56, the user can adjust the probability of display activation in steps of 1/9 from 1/9 to 4/9. The count held by counter 52 can be displayed by suitable display means (not shown).

The coincidence circuitry comprising AND gates 36, 38, 40 and 42, causes the programmed message to be displayed in pseudorandom fashion. At some of the times when the user checks the time on the wristwatch, the message appears. At other times, the message does not appear.

The user cannot predict that the message will or will not appear. If the message appears too infrequently, it will not have the desired psychological effect. Similarly, if it appears too frequently, its effect will be lost. The frequency of message appearance can be adjusted for optimum effect.

One important feature of the coincidence circuitry of FIG. 1 is that the occurrences of a message display are partially dependent on a voluntary stimulus, e.g. checking the time by raising the wristwatch to the viewing position. If the message display were activated merely at randomly selected times, it would be necessary to activate the display for a large fraction of the day, either for short or for long periods of time. In either case, the display would lose its random effect so far as the user is concerned. If the activated periods are short, they would need to be repeated frequency in order for there to be a reasonable probability that the message will be seen at least one or more times in a day. But, if the activated periods are repeated frequently, the user can simply wait for the message to appear. On the other hand, if the activated periods are long, the user, after seeing one message display, would know that there is a high probability that, upon another viewing of the display device a short time later, the message would again appear. The coincidence circuitry overcomes this problem by responding to a stimulus voluntarily given by the user. The display is only activated in response to a voluntary stimulus, and then only for randomly selected voluntary stimuli in accordance with a predetermined probability.

The occurrence of a message display is completely unpredictable by the user. Therefore, if the probability of a message display is properly selected, the message will have the optimum psychological effect. The message can be factory programmed, as can the probability of the occurrence of a message display for a given time check (or other activation signal). Preferably, however, both the message and the probability of its being displayed can be programmed by the user.

Many modifications can be made to the apparatus described above. Examples of such modifications include the following.

The orientation switch is desirable but not essential, as a conventional push-button switch or other activation signal-producing device can be used. For example, in watches with LED displays, push-buttons are sometimes used to activate the time display. The same push-button can be used to generate an activation signal for enabling the pseudorandom display-triggering circuit.

It is not necessary to use multivibrator 76 to turn off the message display after a predetermined interval. If the activation signal is produced by an orientation switch, the orientation switch 12 can be connected to the display driver 16 so that the display is turned on only when the device is in a predetermined proper orientation.

The displayed message can be a moving alphanumeric message, a graphic display, a symbol or group of symbols, or even a simple light. The displayed message can also be a sound, for example a buzzing or bell sound or a computer-synthesized voice, or any other form of message perceptible by the human senses.

The range of probabilities can be increased by the use of additional gates, and the number of selectable probabilities within the available range can be increased by the use of ring counters of larger capacity instead of divide-by-three counters.

Either of counters 28 and 30 can be eliminated. However, if this is done, the adjustability of the probability of a message display will be impaired. For the probability to be adjustable, it will be necessary to provide switching at the input side of gates 36–42 and it will also be desirable to increase the number of gates and to increase the capacity and number of output lines of the remaining counter. By way of specific example, if counter 30 were eliminated, the output of the orientation switch could be connected through switches to inputs of any two of AND gates 36, 38 and 40. The other inputs of these two gates would be connected respectively to two of the three outputs of buffer 32. The outputs of the gates would be connected directly to OR gate 44. If one of the new switches were closed, the probability of a message display would be $\frac{1}{3}$. If two of the switches were closed the probability would be $\frac{2}{3}$. There would only be two choices of probabilities (other than zero and one, of course). The range and resolution of selectable probabilities can be increased by increasing the capacity of counter 28 and adding more gates and switches.

Other schemes for producing pseudorandom displays, such as microprocessor-based schemes can be used alternatively.

Finally, if desired, where the display device includes an orientation switch, it can be made to distinguish unintentional proper orientations from desired proper orientations by the use of an AND gate and a monostable device with an unstable state having a duration exceeding that of a typical unintentional proper orientation.

Other modifications will occur to those skilled in the art and can be made without departing from the scope of the invention as defined in the following claims.

I claim:

1. A personal inspirational display device comprising:

display means for producing a display of a message for a limited time, said display means producing the display only in response to a triggering signal, and substantially immediately upon receipt of a triggering signal;

stimulus-responsive means, responsive to voluntary, human-produced stimul i, for generating an activation signal only each time a voluntary stimulus is given, said activation signal being generated substantially immediately upon occurrence of the voluntary stimulus;

means pseudorandomly responsive to activation signals from said stimulus-response means, for producing a triggering signal only upon receipt of an activation signal and then only upon receipt of some but not all of the activation signals, said pseudorandomly responsive means producing each triggering signal substantially immediately upon receipt of an activation signal; and means for delivering triggering signals to the display means.

2. A personal inspirational display device according to claim 1 in which the message produced by the display means is a visually perceptible message.

3. A personal inspirational display device according to claim 1 in which the pseudorandomly responsive means includes means for predetermining the probability that a triggering signal will be produced by a given activation signal.

4. A personal inspirational display device according to claim 1 comprising a housing containing the display means, stimulus-responsive means, pseudorandomly responsive means and delivering means, and also comprising means for attaching the housing to a human wrist whereby the device an be worn in the manner of wristwatch, and in which the stimulus-responsive means comprises position-sensitive switch means for generating the activation signal when the wrist is positioned to allow the wearer to view the display means.

5. A personal inspirational display device according to claim 4 in which the housing is a wristwatch housing and also contains means for displaying time.

6. A personal inspirational display deice according to claim 1 in which the pseudorandomly responsive means comprises pulse generating means producing a first train of pulses, and in which the stimulus-responsive means produces a second train of pulses, each pulse in the second train corresponding to an activation signal, and including counting means for counting the pulses of one of the first and second pulse trains, and means, responsive to the activation signals, to the count in said counting means, and to the pulses in the other of said first and second pulse trains, for producing the triggering signal upon the coincidence of an activation signal, at least one predetermined count in said counting means and a pulse in said other of said first and second pulse trains.

7. A personal inspirational display device according to claim 6 comprising a housing containing the display means, stimulus-responsive means and delivering means, and means for displaying the time also contained in said housing, the time displaying means including clock pulse counting means connected to count the pulses generated by said generating means.

8. A personal inspirational display device according to claim 1 in which the pseudorandomly responsive means includes pulse generating means, first counting means for counting the pulses generated by said pulse generating means, second counting means for counting said activation signals, and gating means, responsive to the counts in the first and second counting means and to the activation signals, for producing the triggering signal upon the coincidence of an activation signal and at least one predetermined count combination in said first and second counting means.

9. A personal inspirational display device according to claim 8 comprising a housing containing the display means, stimulus-responsive means, pseudorandomly responsive means and delivering means, and means for displaying time also contained in said housing, the time displaying means including clock pulse counting means connected to count the pulses generated by said pulse generating means.

10. A personal inspirational display device comprising:

display means responsive to a triggering signal for producing a display of a message for a limited time;

stimulus-responsive means responsive to a voluntary, human produced stimulus for generating activation signals;

means pseudorandomly responsive to activation signals from said stimulus-responsive means, for producing a triggering signal upon receipt of some but not all of the activation signals;

means for delivering triggering signals to the display means; and means for adjusting said pseudorandomly responsive means to change the probability that a triggering signal will be produced upon receipt of an activation signal.

11. A personal inspirational display device comprising:

display means responsive to a triggering signal for producing display of a message for a limited time;

stimulus-responsive means responsive to a voluntary, human produced stimulus for generating activation signals;

means pseudorandomly responsive to activation signals from said stimulus-responsive means, for producing a triggering signal upon receipt of some but not all of the activation signals; and means for delivering triggering signals to the display means;

in which the pseudorandomly responsive means comprises pulse generating means producing a first train of pulses, and in which the stimulus-responsive means produced a second train of pulses, each pulse in the second train corresponding to an activation signal, and including counting means for counting the pulses of one of the first and second pulse trains, and means, responsive to the activation signals, to the count in said counting means, and to the pulses in the other of said first and second pulse trains, for producing the triggering signal upon the coincidence of an activation signal, at least one predetermined count in said counting means and a pulse in said other of said first and second pulse trains; and including means, connected to said means for producing a triggering signal, for adjusting the probability of occurrence of a triggering signal.

12. A personal inspirational display device comprising:

display means responsive to a triggering signal for producing display of a message for a limited time;

stimulus-responsive means responsive to a voluntary, human produced stimulus for generating activation signals;

means pseudorandomly responsive to activation signals from said stimulus-responsive means, for producing a triggering signal upon receipt of some but not all of the activation signals; and means for delivering triggering signals to the display means;

in which the pseudorandomly responsive means includes pulse generating means, first counting means for counting the pulses generated by said pulse generating means, second counting means for counting said activation signals, and gating means, responsive to the counts in the first and second counting means and to the activation signals, for producing the triggering signal upon the coincidence of an activation signal and at least one predetermined count combination in said first and second counting means; and in which the gating means includes selection means for selecting, from a plurality of possible count combinations in the first and second counting means, a number of count combinations which will cause a triggering signal to be generated when they coincide with an activation signal, whereby the probability of generating a triggering signal upon the occurrence of an activation signal can be varied by operation of said selection means.

13. A personal inspirational display device comprising a wristwatch housing, time display means in said housing, additional display means in said housing, and means in said housing for actuating said additional display means only substantially immediately upon the occurrence of, and in response to stimuli selected pseudorandomly from voluntary, human-produced stimuli occurring each time the user reads the time on said time display, whereby the user of the display device will observe the additional display on some, but not all, of the occasions when the user checks the time displayed on said time display means.

14. A personal inspirational display device according to claim 13 including means for predetermining the probability that the additional display will be actuated for a given occasion when the user checks the time.

15. A personal inspirational display device comprising a wristwatch housing, time display means in said housing, additional display means in said housing, and means in said housing for actuating said additional display means at unpredictable times, whereby the user of the display device will observe the additional display on some, but not all, of the occasions when the user checks the time displayed on said time display means; including means for predetermining the probability that the additional display will be actuated for a given occasion when the user checks the time; and including means for adjusting the probability that the additional display will be actuated for a given occasion when the user checks the time.

* * * * *